US009822583B1

(12) United States Patent
Lin

(10) Patent No.: US 9,822,583 B1
(45) Date of Patent: Nov. 21, 2017

(54) SAFETY WINDOW BLIND

(71) Applicant: Ya-Yin Lin, Chiayi (TW)

(72) Inventor: Ya-Yin Lin, Chiayi (TW)

( * ) Notice: Subject to any disclaimer, the term of this patent is extended or adjusted under 35 U.S.C. 154(b) by 0 days.

(21) Appl. No.: 15/410,154

(22) Filed: Jan. 19, 2017

(51) Int. Cl.

| | |
|---|---|
| ***E06B 9/384*** | (2006.01) |
| ***E06B 9/326*** | (2006.01) |
| ***E06B 9/327*** | (2006.01) |
| ***E06B 9/382*** | (2006.01) |

(52) U.S. Cl.
CPC ..... *E06B 9/384* (2013.01); *E06B 9/326* (2013.01); *E06B 9/327* (2013.01); *E06B 9/382* (2013.01)

(58) Field of Classification Search
CPC ..... E06B 9/384; E06B 9/382; E06B 9/326; E06B 9/327; E06B 2009/2622
See application file for complete search history.

(56) References Cited

U.S. PATENT DOCUMENTS 7,556,080 B2 * 7/2009 Nien ..... E06B 9/30 160/168.1 R
8,381,792 B2 * 2/2013 Perkowitz ..... E06B 9/262 160/243
8,544,522 B2 * 10/2013 Lin ..... E06B 9/262 160/178.3
2006/0060308 A1 * 3/2006 LeBlanc ..... E06B 9/262 160/84.04
2010/0224330 A1 * 9/2010 Liang ..... E06B 9/262 160/84.04
2011/0186242 A1 * 8/2011 Foley ..... A47H 5/02 160/193
2011/0203079 A1 * 8/2011 Anthony ..... E06B 9/262 24/115 F

* cited by examiner

*Primary Examiner* — Blair M Johnson
(74) *Attorney, Agent, or Firm* — LeClairRyan

(57) ABSTRACT

A safety window blind includes a headrail, a blind body and two control units. Each control unit has a spacer cord having a plurality of cord loop units, a plurality of rings, and a control cord passing through the rings, being operable to retract and expand the blind body, and having a plurality of holding segments. Each of the cord loop units has first and second cords respectively forming first and second loops. For each holding segment and a corresponding cord loop unit, the holding segment has a first extending section passing through the first loop, a first turning section bent around the second cord, a second turning section bent around the first cord, and a second extending section passing through the second loop.

3 Claims, 6 Drawing Sheets

SAFETY WINDOW BLIND

FIELD

The disclosure relates to a window blind, and more particularly to a safety window blind.

BACKGROUND

Referring to FIGS. 1 and 2, U.S. Pat. No. 8,544,522B2 discloses a conventional window blind 1 that includes a headrail 11, a blind body 12 and two spaced-apart control units 13. The blind body 12 is hung from the headrail 11 and is expandable and retractable relative to the headrail 11 in an up-down direction. The blind body 12 has a fixing portion 121 connected to the headrail 11, a bottom portion 122 spaced apart from the fixing portion 121, and a plurality of parallel folding portions 123 arranged in the up-down direction between the fixing portion 121 and the bottom portion 122. Each of the control units 13 has a control cord 131 operable to retract and expand the blind body 12, a plurality of rings 132 respectively connected to the folding portions 123 of the blind body 12, and a spacer cord 133. For each of the control units 13, the spacer cord 133 has a main cord portion 134, a plurality of first cord portions 135 spaced apart in the up-down direction and connected to the main cord portion 134, and a plurality of second cord portions 136 connected to the main cord portion 134 and arranged in a manner that, between each adjacent two of the first cord portions 135, there is at least one of the second cord portions 136. Each of the second cord portions 136 is twisted to form a substantially figure-eight shape containing two cord loops 137. The main cord portion 134 has an upper end connected to the headrail 11, and a lower end connected to a lowermost one of the rings 132.

Specifically, the control cord 131 passes through the headrail 11, and has a front section (not shown) disposed in front of the blind body 12 for being operated by a user, and a rear section (as illustrated in FIGS. 1 and 2) disposed behind the blind body 12, downwardly passing through the rings 132, the first cord portions 135 and the cord loops 137 of the second cord portions 136, and finally fastened on the lowermost one of the rings 132.

By virtue of the configuration of the cord loops 137, when the control cord 131 is pulled in a horizontal direction, each of the second cord portions 136 and a corresponding part of the control cord 131 are tightly entwined together to form a knot (similar to an over hand knot), thereby preventing the control cord 131 from being overpulled which may dangerously entangle a child who plays with it.

However, when assembling the abovementioned conventional window blind 1, an operator needs to twist each of the second cord portions 136 to generate the loops 137 for extension of the control cord 131. Since the conventional window blind 1 has a substantial number of the second cord portions 136, and since each second cord portion 136 is relatively short, the abovementioned assembling process is difficult and time-consuming.

SUMMARY

Therefore, an object of the disclosure is to provide a safety window blind that can alleviate at least one of the drawbacks associated with the abovementioned prior art.

Accordingly, the safety window blind includes a headrail, a blind body, and two control units. The blind body is hung retractably from the headrail, and includes a plurality of spaced-apart folding portions arranged in an up-down direction. Each of said control units has a spacer cord, a plurality of rings, and a control cord. The spacer cord has a main cord portion extending in the up-down direction, and a plurality of cord loop units connected to the main cord portion and arranged in the up-down direction. Each of the cord loop units has a first cord forming a first loop, and a second cord spaced apart from the first cord in the up-down direction and forming a second loop. The rings are respectively connected to the folding portions of the blind body. The control cord passes through the rings, is operable to retract and expand the blind body in the up-down direction, and has a plurality of holding segments corresponding respectively in position to the cord loop units. Each of the holding segments has a first extending section, a first turning section, a second turning section, and a second extending section. The first extending section passes through the first loop of a respective one of the cord loop units. The first turning section has a first subsection extending from the first extending section, a second subsection opposite to the first subsection, and a bent subsection interconnecting the first and second subsections, and bent around the second cord of the respective one of the cord loop units, such that one of the first and second subsections of the first turning section is disposed inside of the second loop of the respective one of the cord loop units, and that the other one of the first and second subsections is disposed outside of the second loop of the respective one of the cord loop units. The second turning section has a first subsection extending from the second subsection of the first turning section, a second subsection opposite to the first subsection, and a bent subsection interconnecting the first and second subsections, and bent around the first cord of the respective one of the cord loop units, such that one of the first and second subsections of the second turning section is disposed inside of the first loop of the respective one of the cord loop units, and that the other one of the first and second subsections of the second turning section is disposed outside of the first loop of the respective one of the cord loop units. The second extending section extends from the second subsection of the second turning section, and passes through the second loop of the respective one of the cord loop units.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
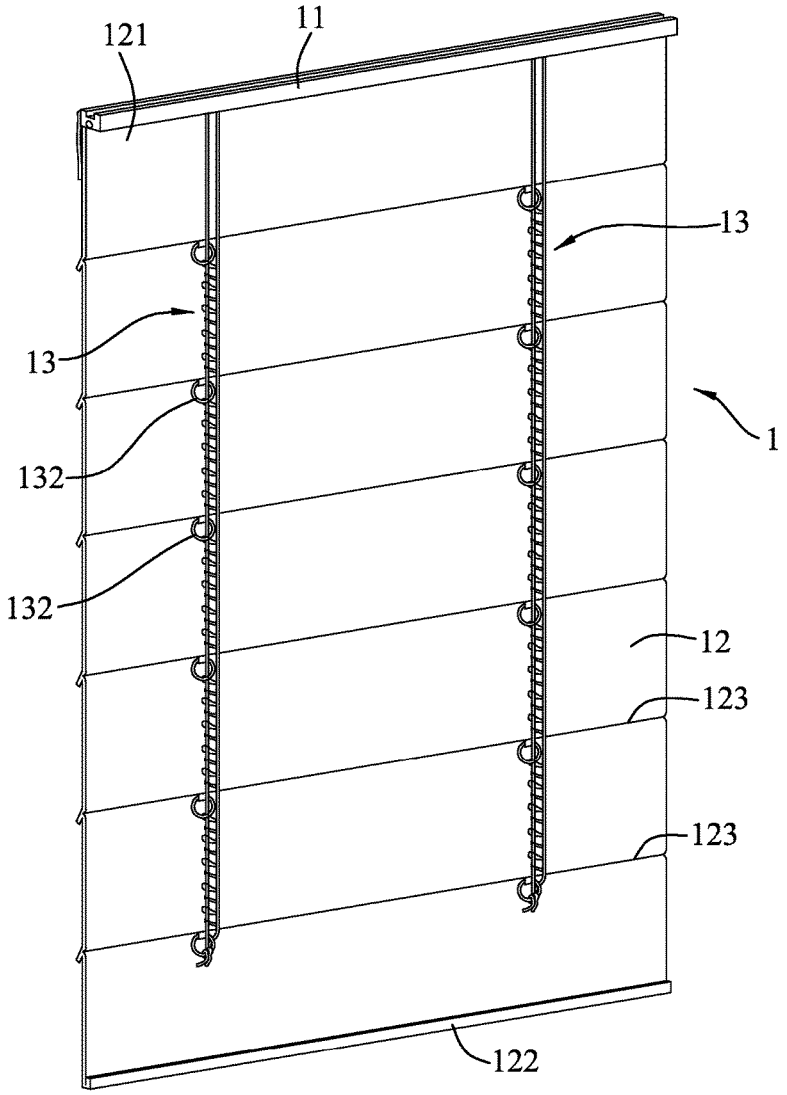
FIG.1 PRIOR ART
FIG. 1 is a perspective view of a conventional window blind disclosed in U.S. Pat. No. 8,544,522B2.
Figure 2:
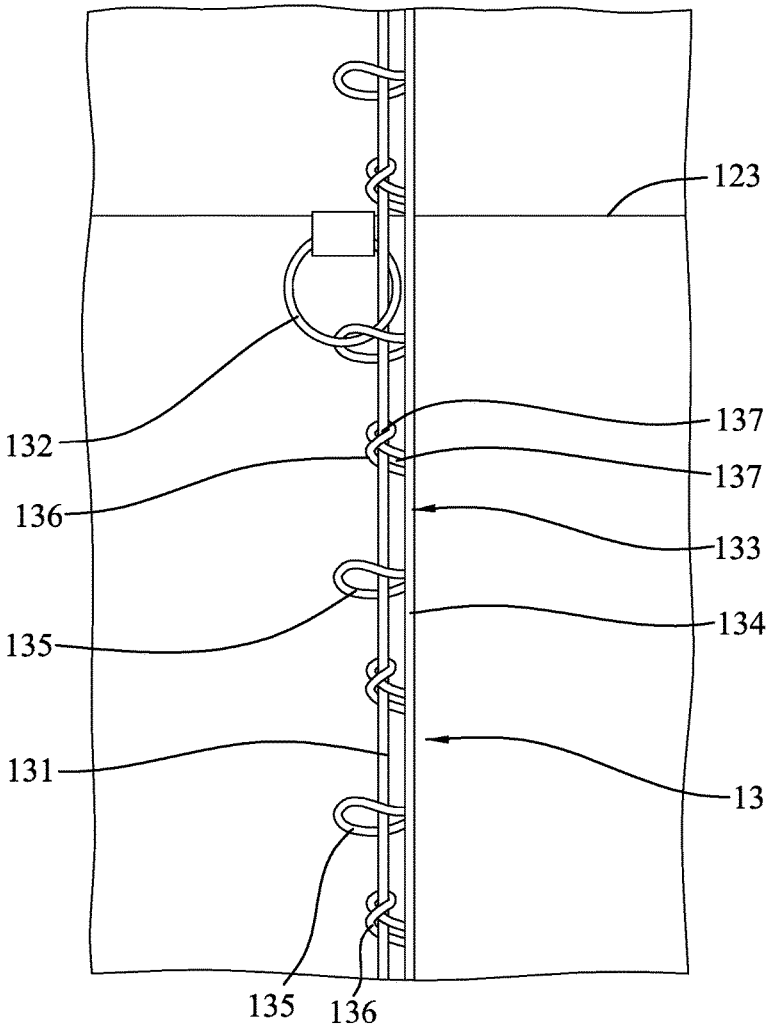
FIG.2 PRIOR ART
FIG. 2 is an enlarged fragmentary front view of FIG. 1, illustrating a control unit of the conventional window blind.
Figure 3:
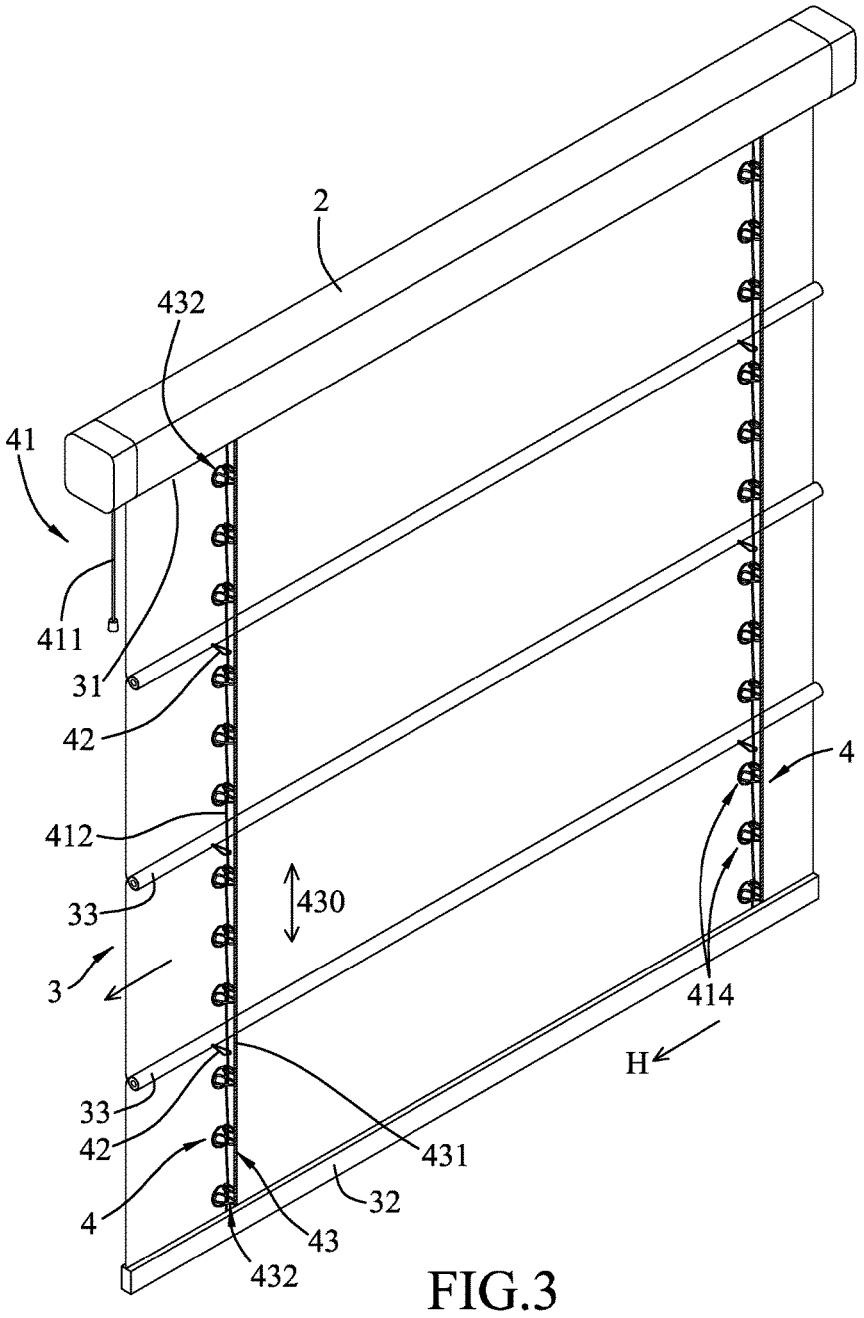
FIG. 3 is a perspective view of a first embodiment of a safety window blind according to the present disclosure.
Figure 4:
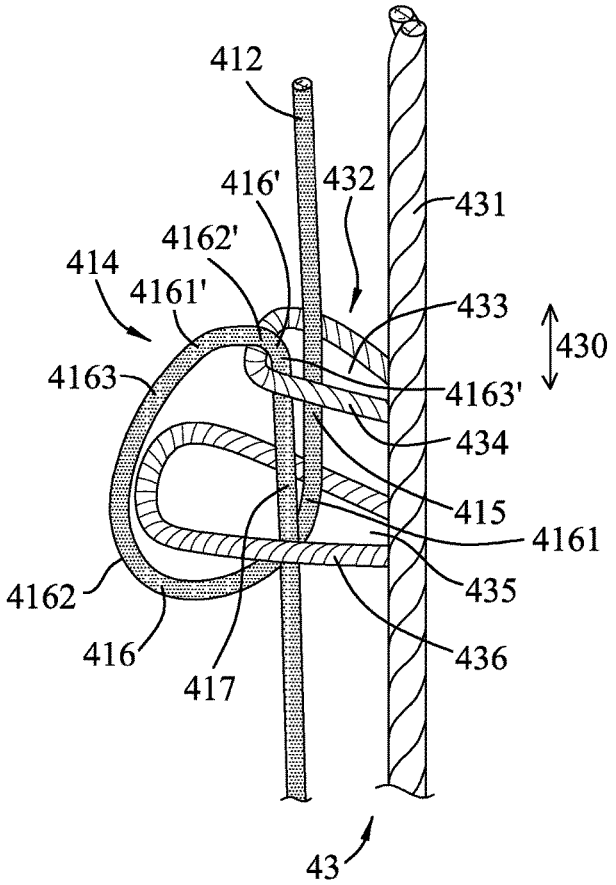
FIG. 4 is a fragmentary perspective view of a control unit of the first embodiment.
Figure 5:
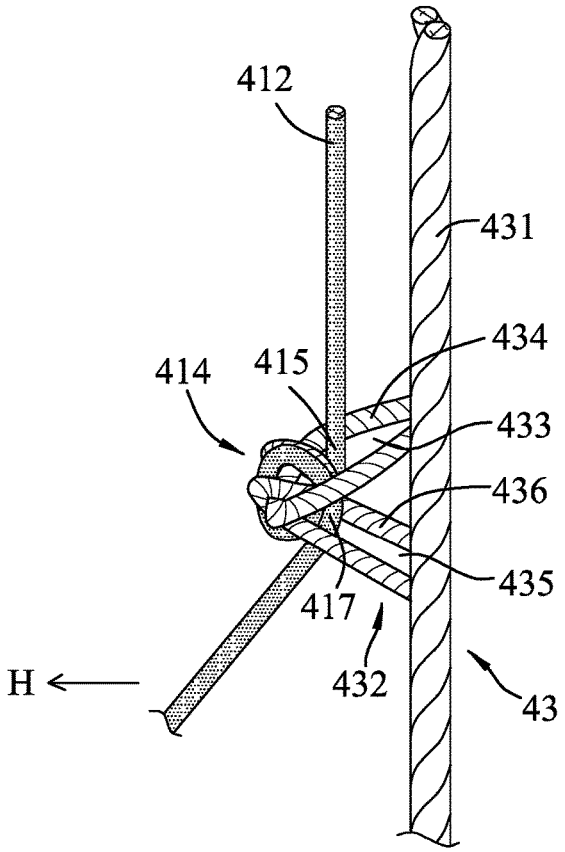
FIG. 5 is another fragmentary perspective view of the control unit, illustrating a control portion thereof being pulled laterally.

Referring to FIGS. 3, 4 and 5, a first embodiment of a safety window blind according to the present disclosure includes a headrail 2, a blind body 3 hung retractably from the headrail 2, and two control units 4 spaced apart from each other in a horizontal direction (H). It should be noted that, the number of the control units 4 may vary in other embodiments. The blind body 3 includes a fixed portion 31 that is mounted to the headrail 2, a bottom portion 32 that is spaced apart from the fixed portion 31, and a plurality of spaced-apart and parallel folding portions 33 that are arranged in an up-down direction 430, and that are disposed between the fixed portion 31 and the bottom portion 32.

In this embodiment, each of the control units 4 has a spacer cord 43, a plurality of rings 42, and a control cord 41. Since the structures of the control units 4 are identical, only one control unit 4 will be described in the following for the sake of brevity. The spacer cord 43 has a main cord portion 431 disposed behind the blind body 3, extending in the up-down direction 430, and interconnecting the headrail 2 and the bottom portion 32 of the blind body 3. The spacer cord 43 further has a plurality of spaced-apart cord loop units 432 connected to the main cord portion 431 and arranged in the up-down direction 430. The rings 42 are respectively connected to the folding portions 33 of the blind body 3. The control cord 41 is operable to retract and expand the blind body 3 in the up-down direction 430. The control cord 41 has a hanging portion 411 extending from the headrail 2 and disposed in front of the blind body 3, and a control portion 412 disposed behind the blind body 3, passing through the rings 42, and having a distal end that is fastened on the bottom portion 32 of the blind body 3. It should be noted that the distal end of the control portion 412 may be fastened on a lowermost one of the rings 42 in other embodiments.

Each of the cord loop units 432 has a first cord 434 that forms a first loop 433, and a second cord 436 that is spaced apart from the first cord 434 in the up-down direction 430, and that forms a second loop 435. For each of the cord loop units 432, the second cord 436 is disposed under the first cord 434, and is longer than the first cord 434. The control portion 412 of the control cord 41 has a plurality of holding segments 414 corresponding respectively in position to the cord loop units 432. Each of the holding segments 414 has a first extending section 415, a first turning section 416, a second turning section 416', and a second extending section 417. The first extending section 415 passes through the first loop 433 of a respective one of the cord loop units 432. The first turning section 416 has a first subsection 4161 extending from the first extending section 415, a second subsection 4163 opposite to the first extending section 415, and a bent subsection 4162 interconnecting the first and second subsections 4161, 4163, and bent around the second cord 436 of the respective one of the cord loop units 432. The second turning section 416' has a first subsection 4161' extending from the second subsection 4163 of the first turning section 416, a second subsection 4163' opposite to the first subsection 4161', and a bent subsection 4162' interconnecting the first and second subsections 4161', 4163' of the second turning section 416', and bent around the first cord 434 of the respective one of the cord loop units 432. The second extending section 417 extends from the second subsection 4163' of the second turning section 416', and passes through the second loop 435 of the respective one of the cord loop units 432.

When assembling the safety window blind of this embodiment, an operator first needs to stitch the rings 42 respectively onto the folding portions 33 of the blind body 3, and fasten the main cord portion 431 of the spacer cord 43 between the headrail 2 and the bottom portion 32 of the blind body 3. Then, the control portion 412 is guided downwardly from the headrail 2 to pass through the rings 42 with the holding segments 414 respectively engaging the cord loop units 432. To be more specific, the first extending portion 415 is passed downwardly through the first loop 433 of the respective one of the cord loop units 432, and the bent subsection 4162 of the first turning section 416 is bent upwardly around the second cord 436 of the respective one of the cord loop units 432, such that the first and second subsections 4161, 4163 of the first turning section 416 are disposed respectively inside and outside of the second loop 435 of the respective one of the cord loop units 432. Afterwards, the bent subsection 4162' of the second turning section 416' is bent downwardly around the first cord 434 of the respective one of the cord loop units 432, such that the first and second subsections 4161', 4163' of the second turning section 416' are disposed respectively outside and inside of the first loop 433 of the respective one of the cord loop units 432. Finally, the second extending section 417 is passed downwardly through the second loop 435 of the respective one of the cord loop units 432. After the control portion 412 of the control cord 41 passes through all the rings 42 and engages all of the cord loop units 432, the distal end of the control portion 412 is fastened on the bottom portion 32 of the blind body 3, thereby completing the assembling of the safety window blind.

In use, when a child pulls the control portion 412 of the control cord 41 in the horizontal direction (H), distal portions of the first and second cords 434, 436 of each of the cord loop units 432 are drawn toward each other, as illustrated in FIG. 5. Since the second cord 436 is longer than the first cord 434, the distal portion of the second cord 436 is wound onto the distal portion of the first cord 434. At this time, the control portion 412, and the distal portions of the first and second cords 434, 436 are tied together to form a knot (see FIG. 5), which prevents the control cord 41 from being continually pulled away from the blind body 3 and entangling the child. It should be noted that, while the second cord 436 is longer than the first cord 434 in this embodiment, the length of the first cord 434 may be equal to that of the second cord 436 in other embodiments.

The operator may thread the control cord 41 through a needle for facilitating extension of the control portion 412 of the control cord 41 in the abovementioned specific way to engage the cord loop units 432. In comparison with the aforesaid conventional window blind, the operator can complete the assembling of the safety window blind without having to twist the first and second cords 434, 436, thus the assembling of the safety window blind of the present disclosure is more convenient.

Figure 6:
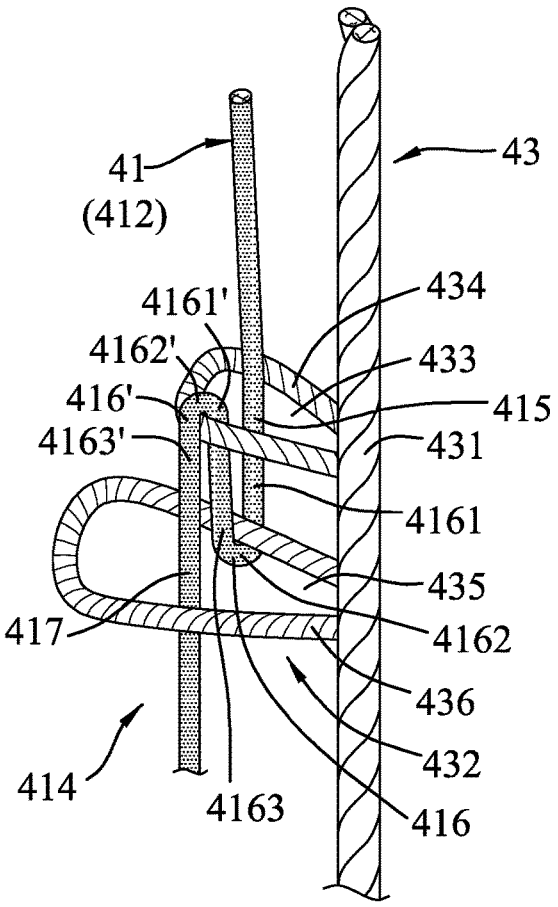
FIG. 6 is a fragmentary perspective view of the control unit of a second embodiment of the safety window blind according to the present disclosure.

Referring to FIG. 6, a second embodiment of the safety window blind according to the present disclosure has a structure similar to that of the first embodiment. The main differences between this embodiment and the previous embodiment reside in that, for each of the holding segments 414, the bent subsection 4162 of the first turning section 416 is bent upwardly around the second cord 436 of the respective one of the cord loop units 432, such that the first and second subsections 4161, 4163 of the first turning section 416 are disposed respectively outside and inside of the second loop 435 of the respective one of the cord loop units 432, and the bent subsection 4162' of the second turning section 416' is bent downwardly around the first cord 434 of the respective one of the cord loop units 432, such that the first and second subsections 4161', 4163' of the second turning section 416' are disposed respectively inside and outside of the first loop 433 of the respective one of the cord loop units 432. The second embodiment has the same advantages as those of the first embodiment.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that his disclosure is not limited to the disclosed embodiment but is intended to cover various arrangements included within the spirit and scope of the broadest interpretation so as to encompass all such modifications and equivalent arrangements.

What is claimed is:

1. A safety window blind comprising:

a headrail;

a blind body hung retractably from said headrail, and including a plurality of spaced-apart folding portions that are arranged in an up-down direction; and two control units, each of which having a spacer cord that has a main cord portion extending in the up-down direction, and a plurality of cord loop units connected to said main cord portion and arranged in the up-down direction, each of said cord loop units having a first cord that forms a first loop, and a second cord that is spaced apart from the first cord in the up-down direction, and that forms a second loop, a plurality of rings that are respectively connected to said folding portions of said blind body, and a control cord that passes through said rings, that is operable to retract and expand said blind body in the up-down direction, and that has a plurality of holding segments corresponding respectively in position to said cord loop units, each of said holding segments having a first extending section that passes through said first loop of a respective one of said cord loop units, a first turning section that has a first subsection that extends from said first extending section, a second subsection that is opposite to said first subsection, and a bent subsection that interconnects said first and second subsections and that is bent around said second cord of the respective one of said cord loop units such that one of said first and second subsections of said first turning section is disposed inside of said second loop of the respective one of said cord loop units, and that the other one of said first and second subsections is disposed outside of said second loop of the respective one of said cord loop units, a second turning section that has a first subsection that extends from said second subsection of said first turning section, a second subsection that is opposite to said first subsection, and a bent subsection that interconnects said first and second subsections, and that is bent around said first cord of the respective one of said cord loop units such that one of said first and second subsections of said second turning section is disposed inside of said first loop of the respective one of said cord loop units, and that the other one of said first and second subsections of said second turning section is disposed outside of said first loop of the respective one of said cord loop units, and a second extending section that extends from said second subsection of said second turning section, and that passes through said second loop of the respective one of said cord loop units.

2. The safety window blind as claimed in claim 1, wherein:

for each of said cord loop units of said spacer cord, said second cord is disposed under said first cord, and said second cord is longer than said first cord; and for each of said holding segments of said control cord, said first extending section passes downwardly through said first loop of the respective one of said cord loop units, said bent subsection of said first turning section is bent upwardly around said second cord of the respective one of said cord loop units such that said first and second subsections of said first turning section are disposed respectively inside and outside of said second loop of the respective one of said cord loop units, said bent subsection of said second turning section is bent downwardly around said first cord of the respective one of said cord loop units such that said first and second subsections of said second turning section are disposed respectively outside and inside of said first loop of the respective one of said cord loop units, and said second extending section passes downwardly through said second loop of the respective one of said cord loop units.

3. The safety window blind as claimed in claim 1, wherein:

for each of said cord loop units of said spacer cord, said second cord is disposed under said first cord, and said second cord is longer than said first cord; and for each of said holding segments of said control cord, said first extending section passes downwardly through said first loop of the respective one of said cord loop units, said bent subsection of said first turning section is bent upwardly around said second cord of the respective one of said cord loop units such that said first and second subsections of said first turning section are disposed respectively outside and inside of said second loop of the respective one of said cord loop units, said bent subsection of said second turning section is bent downwardly around said first cord of the respective one of said cord loop units such that said first and second subsections of said second turning section are disposed respectively inside and outside of said first loop of the respective one of said cord loop units, and said second extending section passes downwardly through said second loop of the respective one of said cord loop units.

* * * * *